US012565296B2

(12) United States Patent
Thoren et al.

(10) Patent No.: US 12,565,296 B2
(45) Date of Patent: Mar. 3, 2026

(54) RAPID REPLACEMENT CONTROL FIN FOR AN UNDERWATER VEHICLE

(71) Applicant: BAE Systems Information and Electronic Systems Integration Inc., Nashua, NH (US)

(72) Inventors: Matthew D. Thoren, Pelham, NH (US); John C. Cobb, Plymouth, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 542 days.

(21) Appl. No.: 18/149,828

(22) Filed: Jan. 4, 2023

(65) Prior Publication Data

US 2024/0217638 A1 Jul. 4, 2024

(51) Int. Cl.
*B63G 8/18* (2006.01)

(52) U.S. Cl.
CPC ..... *B63G 8/18* (2013.01)

(58) Field of Classification Search
CPC ..... B63G 8/18; B63B 32/66
See application file for complete search history.

(56) References Cited

U.S. PATENT DOCUMENTS

| | | | | |
|---|---|---|---|---|
| 5,597,337 | A | 1/1997 | Nedderman, Jr. | |
| 5,615,632 | A | 4/1997 | Nedderman, Jr. | |
| 6,640,740 | B1 | 11/2003 | French et al. | |
| 7,108,571 | B2 | 9/2006 | Geraghty | |
| 8,539,898 | B1 | 9/2013 | Sylvia et al. | |
| 9,090,318 | B2 * | 7/2015 | Koelling | F16B 2/14 |
| 9,381,987 | B1 | 7/2016 | Dufour et al. | |
| 9,862,467 | B2 | 1/2018 | Norrie et al. | |
| 10,202,993 | B2 * | 2/2019 | Koelling | A43C 15/161 |
| 10,773,780 | B2 | 9/2020 | Smith et al. | |
| 2008/0041293 | A1 | 2/2008 | Diorio et al. | |

(Continued)

FOREIGN PATENT DOCUMENTS

| | | | |
|---|---|---|---|
| WO | 88/09744 | A1 | 12/1988 |
| WO | 2022/214651 | A1 | 10/2022 |

OTHER PUBLICATIONS

Bal Seal Engineering, Lor Lock and Quick Release System for Mechanical and Electrical Application, Product News 290-75 (Rev. 02, Feb. 27, 2020).

(Continued)

*Primary Examiner* — Anthony D Wiest
(74) *Attorney, Agent, or Firm* — Gary McFaline

(57) ABSTRACT

A replacement fin for an underwater vehicle includes a fin defining a socket that includes a bore of a first diameter and an internal spring recess of a larger diameter. A coil spring is retained in the spring recess and has coils of an elongated coil shape. The coil spring can occupy a first canted position in which the coils are canted in a direction generally into the bore and the coils can occupy a second canted position in which the coils are canted in a direction generally out of the bore. The UUV has a post that can include at least one circumferential recess configured to engage the coil spring, and which can function as a lock in some canted orientations of the spring. Alternately, the socket is defined in the UUV and the fin includes a post sized to be received in the socket.

18 Claims, 8 Drawing Sheets

(56) References Cited

U.S. PATENT DOCUMENTS

| | | | | |
|---|---|---|---|---|
| 2008/0220672 | A1 | 9/2008 | Koelling et al. | |
| 2009/0185853 | A1* | 7/2009 | Koelling ..... | A63C 17/26<br>403/220 |
| 2019/0256176 | A1 | 8/2019 | Mach | |
| 2022/0169350 | A1 | 6/2022 | Van Valkenburgh et al. | |

OTHER PUBLICATIONS

Bal Seal Engineering, Canted Coil Springs, https://www.balseal.com/spring/ (accessed Oct. 24, 2022).

* cited by examiner

RAPID REPLACEMENT CONTROL FIN FOR AN UNDERWATER VEHICLE

TECHNICAL FIELD

The present disclosure relates generally to flight control components of underwater vehicles, including unmanned underwater vehicles (UUVs), which are sometimes referred to as autonomous underwater vehicles (AUV). More particularly, the present disclosure relates to a rapid replacement fin for underwater vehicles.

BACKGROUND

An unmanned underwater vehicle (UUV) is a submersible vehicle that can operate underwater without a human occupant. Some such vehicles are remotely operated while others are autonomously controlled. In many cases, the UUV has the shape of a torpedo to minimize the vehicle's drag in the water. Flight surfaces or fins, such as elevator fins or a rudder, are generally mounted forward of the propeller at the rear of the vehicle. Hydrostatic forces of water moving over the flight surfaces are used to adjust heading and depth. Other undersea units including undersea drones, torpedoes and submarines also have fins and rudders for movement and will be collectively referred to as underwater vehicles.

SUMMARY

The present disclosure is directed to a replacement fin for underwater vehicles, a replacement fin system, and methodologies for the same. The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
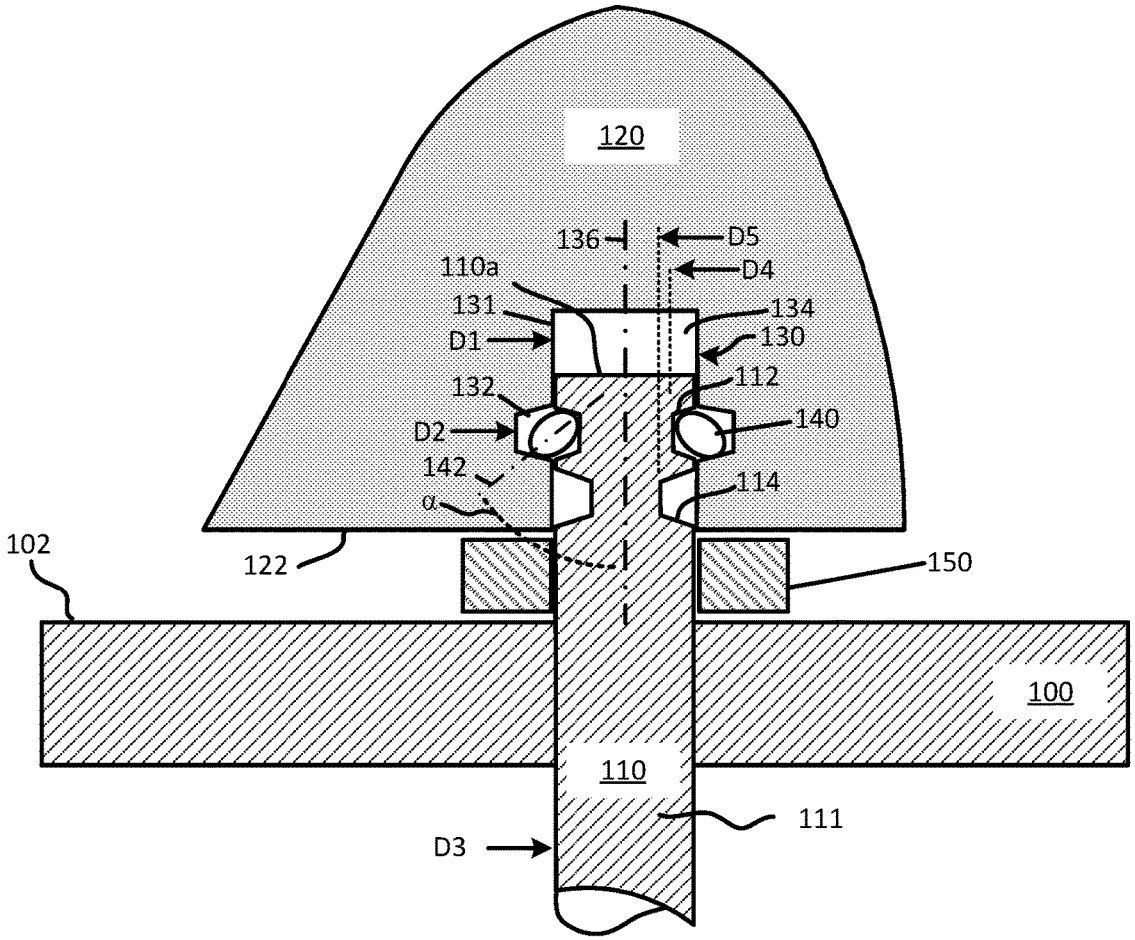
FIG. 1 illustrates a cross-sectional view showing part of a UUV with an installed replaceable fin and a spacer, where the shaft is part of the UUV and the fin is in an operating position, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a replacement fin system and techniques for a toolless replacement fin for underwater vehicles, including an unmanned underwater vehicle (UUV). For convenience, the descriptions will be directed to UUVs, but the techniques and structures disclosed herein are not limited to UUVs. In accordance with one embodiment, a replacement fin includes a shaft that protrudes from the base of the fin and is configured to be received in a corresponding socket in the UUV. Alternately, the shaft is part of the UUV and the fin defines the socket. In either configuration, the socket includes a bore sized to receive the shaft and further includes a spring recess that extends circumferentially around an inside of the bore. A canted coil spring is retained in the spring recess. The inner diameter of the spring can change from a smaller diameter to a larger diameter when the shaft is installed in the socket. The spring can be canted in a direction generally into the socket or generally out of the socket, where the cant direction can be reversed.

The shaft includes at least one circumferential groove. When the shaft is inserted into the socket, the coil spring is canted in a first direction where the coils are inclined in the same general direction as the shaft movement into the socket. Accordingly, the spring allows a relatively low force insertion of the shaft with the spring coils engaging the shaft body. As the shaft is further inserted into the socket so that the first groove aligns with the spring recess, the coil spring expands into the groove on the shaft. In this position, also referred to as the operating position, the coil spring occupies both the first groove and the spring recess. In its first canted orientation, the coils of the spring may extend at an angle into a corner of the groove on the shaft. In such position, the canted coil spring functions as a block or latch between the shaft and the socket so that the coil spring opposes removal of the shaft. Thus, significant force (e.g., 20×-50× the insertion force) is required to remove the shaft from the socket.

In some embodiments, the shaft includes a second circumferential groove of greater radial depth than the first circumferential groove. As the shaft is inserted further into the socket from the operating position, the coil spring expands into the second groove. Due to the increased radial depth of the second groove, the coil spring is able to first occupy a neutral cant and then can reverse its cant direction when the shaft begins moving in the opposite direction out of the socket. When the cant is reversed, the coils are oriented in the direction of removal so that the shaft can be removed with relatively low force from the socket.

Absent the second groove on the shaft, the shaft may be removed from the socket by first inserting the shaft into the socket beyond its operating position so that the coil spring engages the body of the shaft rather than the groove. In such position, the shaft can then be quickly withdrawn from the socket so as to prevent the coil spring from seating in the circumferential groove on the shaft where it functions as a block.

A spacer can be installed on the shaft between the fin and the UUV to prevent inserting the shaft beyond a specified depth. For example, the spacer can be a locking ring or shaft collar that prevents insertion beyond the operating position of the shaft.

In accordance with some embodiments of the present disclosure, the shaft, socket, and locking ring or spacer can be part of a replacement fin system for a UUV. The replacement fin system enables rapid and toolless removal and replacement of a fin.

Overview

Unmanned underwater vehicles (UUVs) have fins that are used to control direction and depth of the UUV as it moves through the water. The fins can include movable and fixed fins. The fins extend from the body of the UUV and therefore are subject to impact with other objects. In the event that a fin becomes damaged or otherwise needs to be replaced, doing so requires opening the UUV, removing electronics, and breaking several sealed interfaces. The task requires tools and can be time consuming and complicated, particularly when performed in the field. Accordingly, a need exists for a replacement fin system that simplifies replacement of a damaged fin. A need also exists for a fin that can be installed and/or removed without tools.

The present disclosure addresses these needs and others by providing a replacement fin for a UUV that is configured for simplified and toolless removal and installation. In accordance with some embodiments of the present disclosure, a replacement fin includes a shaft configured to be received in a corresponding socket on the UUV (or vice versa) where the socket includes a canted coil spring. The assembly can further include a spacer or locking ring between the UUV and the fin. In some embodiment, the fin and/or the socket include a non-circular surface for alignment of the fin and for control of the fin.

A replacement fin incorporating some or all of the features disclosed herein advantageously reduces the mean time to repair (MTTR) or replace fins on fielded UUVs. Also, fin replacement is simple and easy to do without specialized training. Further, no tools are required. Still further, a replacement fin of the present disclosure avoids perturbations in the control fin surface and adverse hydrodynamic effects. Still further, a replacement fin can be configured without a sealed shaft or cavities, thereby avoiding issues associated with depth and pressure in underwater environments.

Example Embodiments

FIG. 1 illustrates a side and cross-sectional view showing part of a UUV 100 with an installed fin 120, in accordance with an embodiment of the present disclosure. In this example, the fin 120 defines a socket 130 that includes a bore 131 of a first diameter D1 and a circumferential spring recess 132 of a second diameter D2 that is greater than the first diameter D1. In one example, the bore 131 can be a blind bore machined or formed into the fin 120 through the base 122 of the fin. In another example, the socket 130 is defined at least in part by an insert installed in a body of the fin 120.

The spring recess 132 has a radial depth and an axial height sized and configured to retain a canted coil spring 140 of a closed loop geometry (e.g., a circle). The spring recess 132 can have a profile that is rectangular, trapezoidal, rounded, a V-shape, or other suitable shape. In one example, the radial depth of the spring recess 132 is less than the difference between the inner diameter ID and outer diameter OD of the coil spring 140 in its resting state. In one embodiment, when coils of the coil spring 140 have an elliptical or other elongated coil shape, the axial height of the spring recess 132 is less than a major axis of coils of the coil spring 140, and greater than a minor axis of the coils.

The UUV 100 includes a post or shaft 110 that extends beyond an outer surface 102 of the UUV 100 and has a shaft body 111 sized to be received in the socket 130. The shaft 110 can be integrally formed as part of the UUV housing or can be a separate component that is attached to or installed on the UUV. In some embodiments, the socket 130 can define one or more axial slots to permit pressure equalization between the socket 130 and the environment. The shaft 110 is discussed in more detail below.

A spacer 150 can be installed on the shaft 110 between the outer surface 102 of the UUV and the base 122 of the fin 120. The spacer 150 can be configured, for example, as a lock ring, a washer, a shaft collar, or split ring that can be fixedly or loosely installed on the shaft 110. In one example, the spacer 150 is a shaft collar with two semicircular portions that can be fastened together around the shaft 110 using fasteners. In one such embodiment, halves of the spacer 150 can be hingedly connected. Optionally, the spacer 150 can be fixed to the shaft 110 using a set screw or the like. The spacer 150 can be made of a variety of materials, including metals, polymers, and composites.

A canted coil spring 140 is received at least in part in the spring recess 132. For example, the resting inner diameter ID of the canted coil spring 140 is greater than the second diameter D2. Accordingly, when the shaft 110 is installed in the socket 130, the shaft body 111 engages the canted coil spring 140 and causes it to occupy a loaded position with an increased inner diameter ID that is substantially equal (e.g., equal to or less than by up to 0.010") to the first diameter D1 of the bore 131. In the example of FIG. 1, coils of the coil spring 140 are oriented along a coil axis 142 towards a distal corner of the first groove 112. In such position, the coil spring 140 is wedged between the fin 120 and the shaft 110 and, owing to the coil axis 142 and elongated coil shape, the coil spring 140 functions as a latch or block to resist removal of the shaft 110. In some embodiments, the force of removing the shaft 110 when the coil spring 140 is canted in a direction opposite of removal direction is 20×-50× the removal force when the canted coil spring is canted in the direction of removal.

Although the fin 120 is shown in use with a shaft 110 having circumferential grooves 112, 114, it is contemplated that a fin 120 as variously disclosed herein can be provided for use with a shaft 110 that lacks circumferential grooves. For example, the coil spring 140 retained in the circumferential spring recess 132 can engage the shaft 110 with sufficient force to retain the fin 120 on the shaft 110 without the need for the coil spring 140 to lock with a circumferential groove. Numerous variations and embodiments will be apparent in light of the present disclosure.

Figure 2:
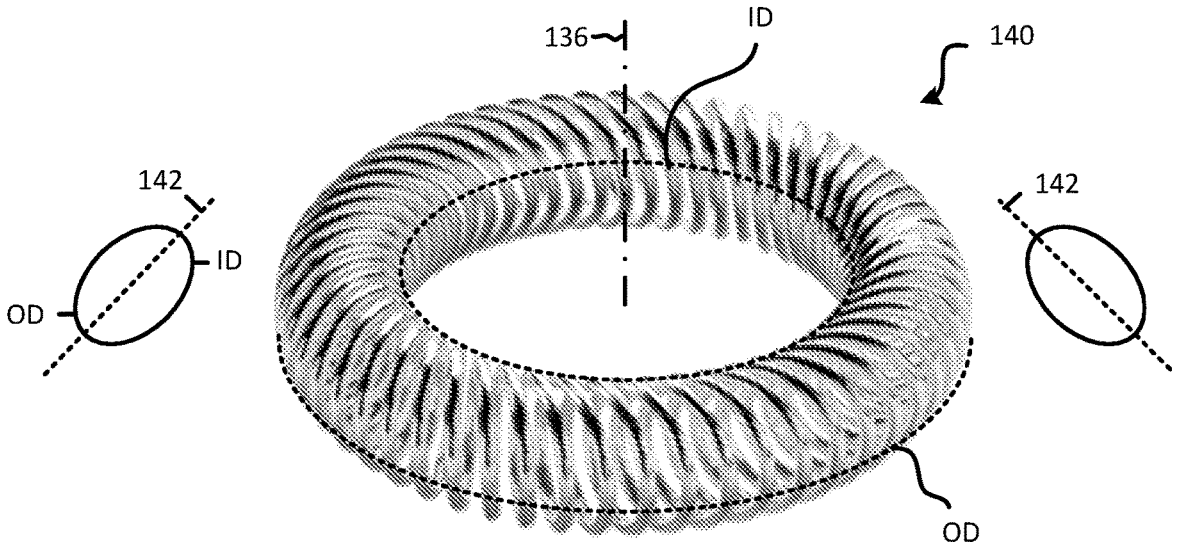
FIG. 2 illustrates a perspective view of a canted coil spring, in accordance with an embodiment of the present disclosure.

FIG. 2 illustrates a perspective view of a coil spring 140, in accordance with an embodiment of the present disclosure. At the right and left sides of FIG. 2, coils of the coil spring 140 are illustrated in a cross-sectional view looking in a direction perpendicular to the central axis 136. The coil spring 140 has an inner diameter ID and an outer diameter OD. Note that in this cant orientation the inner diameter ID and outer diameter OD are vertically offset from each other. In more detail, the inner diameter ID is vertically above a center of the coil shape and the outer diameter OD is vertically below the center of the coil shape. Spring coils of the coil spring 140 have an elongated shape (e.g., oval or elliptical) oriented along a coil axis 142. In some positions of the coil spring 140, the coil axis 142 defines a cant angle $\alpha$ (shown in FIG. 1) from 20°-70° with respect to a central axis 136 of the socket 130 in the resting position, as viewed in a cross-sectional view of the coil spring 140 in a direction perpendicular to the central axis 136. The cant angle $\alpha$ can be 40°-60° or about 45°, in some embodiments. In a position of neutral cant, the coil axis 142 is substantially perpendicular to the central axis 136, resulting in a coil angle $\alpha$ of 90±5°. In the example of FIG. 2, the cant angle $\alpha$ is about 45°.

Figure 3:
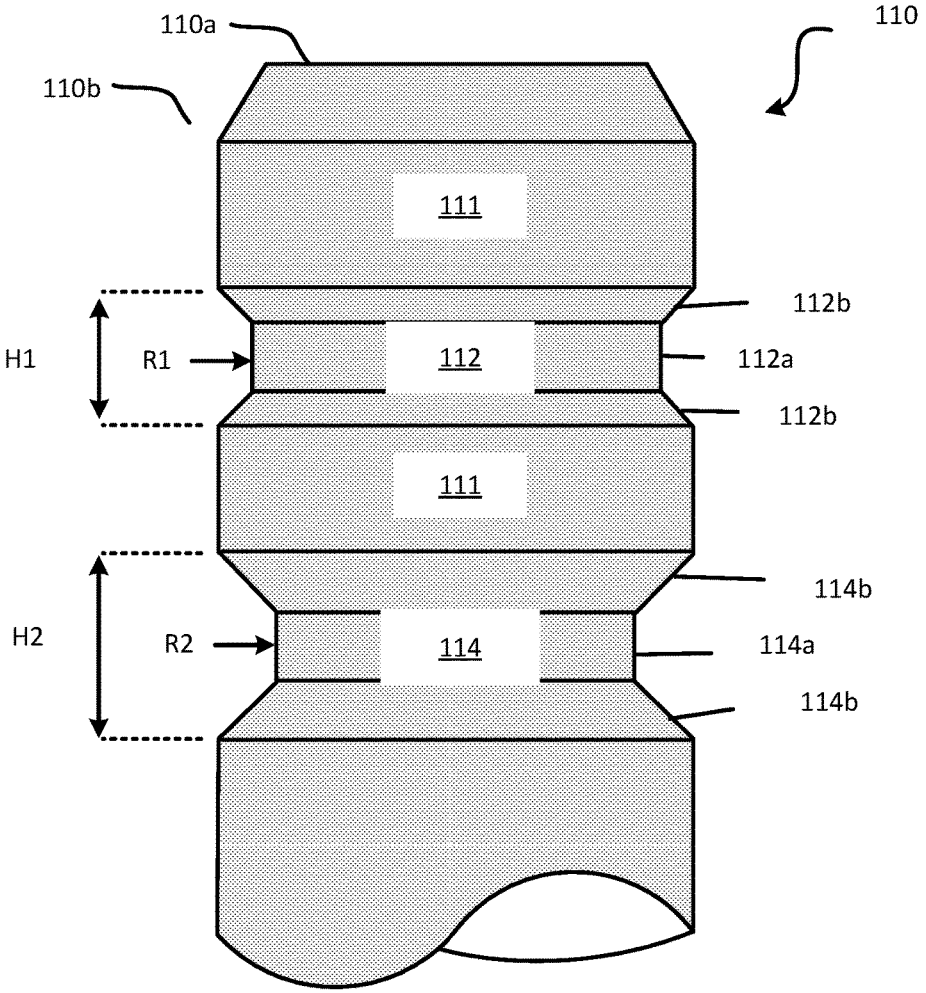
FIG. 3 illustrates part of a shaft with first and second grooves, in accordance with an embodiment of the present disclosure.

Referring now to FIG. 3, and with continued reference to FIG. 1, a side view of a shaft 110 is illustrated, in accordance with an embodiment of the present disclosure. The shaft 110 has a shaft body 111 with a body diameter D3 or outer shaft diameter D3 that is sized to be snugly received in the socket 130 with the desired tolerances. That is, body diameter D3 is somewhat less than the bore diameter or first diameter D1 of the socket 130. In some embodiments, the body diameter D3 differs from the first diameter D1 by no more than 0.010" or no more than 0.005". The shaft 110 defines a circumferential first groove 112 of diameter D4 that is less than the body diameter D3 of the shaft 110. The difference in radius between the shaft body 111 and first groove 112 can be referred to as the radial depth of the first groove 112. When the first groove 112 is axially aligned with the spring recess 132, the coil spring 140 relaxes somewhat from its loaded position and it becomes partly received in the first groove 112 in a canted position. This position may be referred to as the operating position and is shown for example in FIG. 1. Note that in the operating position a gap 134 exists between the distal end 110*a* of the shaft 110 and the blind end 130*a* of the socket 130. This gap allows the shaft 110 to be further inserted into the socket 130 as needed for removing the shaft 110.

In some embodiments, the shaft 110 defines a circumferential second groove 114 that is spaced axially from the first groove 112. The first groove 112 is positioned axially between the second groove 114 and the distal end 110*a* of the shaft 110. The second groove 114 has a diameter D5 that is less than the diameter D4 of the first groove 112. That is, the second groove 114 has a greater radial depth R2 than radial depth R1 of the first groove 112. The radial depth of the second groove 114 is selected to enable the coil spring 140 to attain a neutral cant and to reverse its cant orientation. A gap 134 at the distal end 110*a* of the shaft 110 is sized to enable the second groove 114 to be aligned with the spring recess 132.

In some embodiments, one or both of the first groove 112 and second groove 114 have sloped transitions 112*b*, 114*b* between the shaft body 111 and the axial wall 112*a*, 114*a* in a middle of the groove. Also, in some embodiments, the first groove 112 and the second groove 114 can differ in axial height H. For example, the first groove 112 has a first axial height H1 and the second groove 114 has a second axial height H2 that is greater than the first axial height H1. The axial height H, sloped transitions 112*b*, 114*b*, and radial depth R can be selected individually or in combination to promote a canted or neutral position of the coil spring 140 when it is seated in the groove.

In some embodiments, the distal end portion 110*b* of the shaft 110 can be keyed, have a flat or flats, or define some other geometry that enables aligning the shaft 110 with the socket 130 and/or engaging control mechanisms (not shown). For example, the distal end portion 110*b* has a cross-sectional D-shape or I-shape that mates with corresponding control surfaces.

Figure 4:
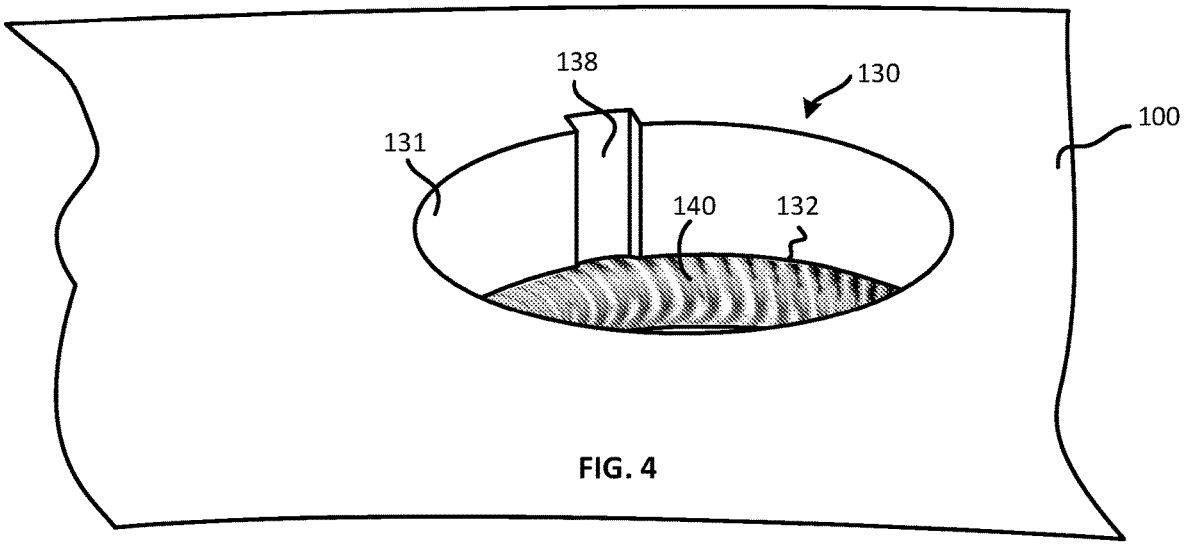
FIG. 4 illustrates a perspective view of part of a UUV and a socket defined in the body thereof, in accordance with an embodiment of the present disclosure.

FIG. 4 illustrates a perspective view of a socket 130 defined in a UUV 100, in accordance with an embodiment of the present disclosure. In this example, the socket 130 is defined in the body of a UUV 100. A keyway 138 extends axially and communicates with the bore 131 of the socket 130. A coil spring 140 occupies a spring recess 132 that extends circumferentially around an inside of the bore 131. The socket 130 and shaft 110 can be made of or include surfaces of stainless steel, titanium, polyetheretherketone (PEEK), or fluorinated polymers to name a few examples.

Figure 5:
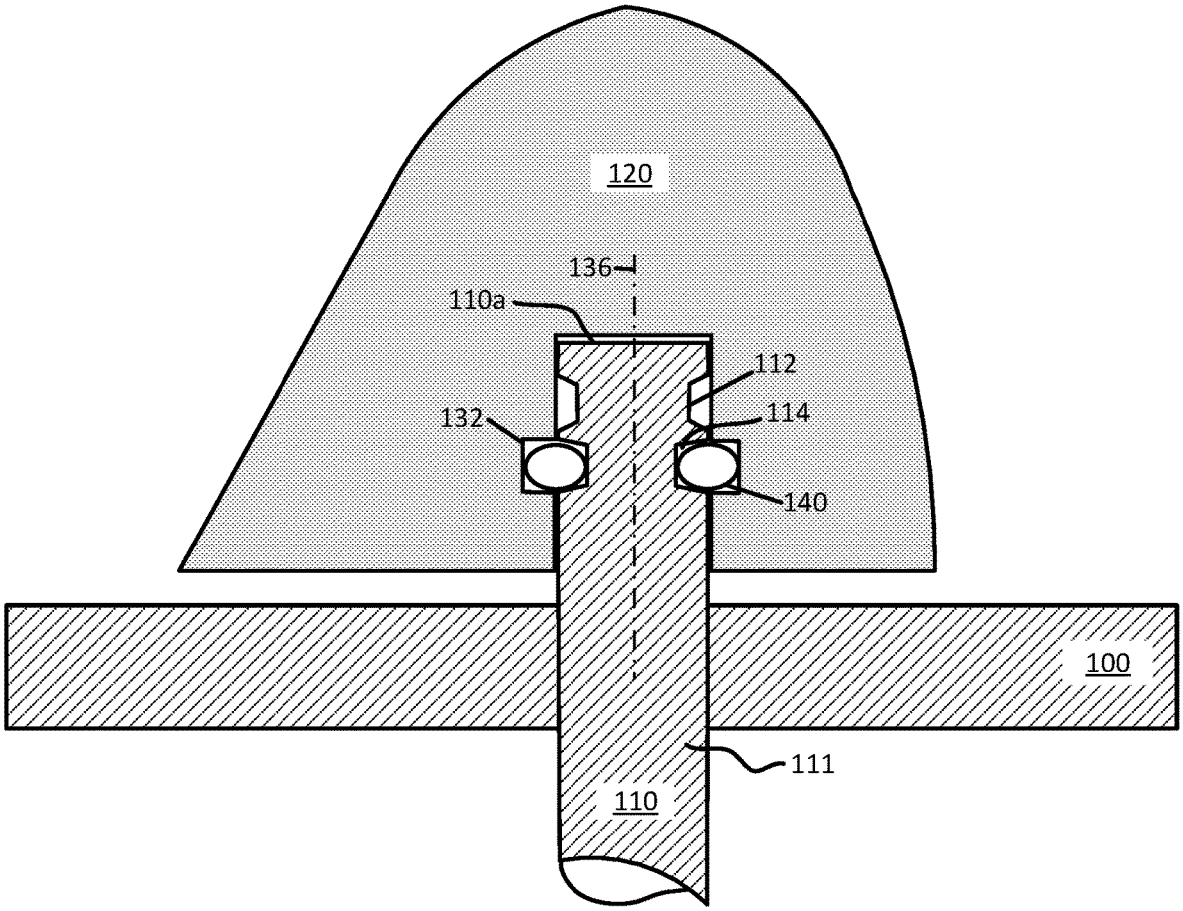
FIG. 5 illustrates a cross-sectional view of a fin and UUV, where the spacer has been removed and the shaft has been inserted further into the socket so that the coil spring is seated in a second groove on the shaft, in accordance with an embodiment of the present disclosure.

FIG. 5 illustrates a side and cross-sectional view showing the fin 120 and portion of the UUV 100 of FIG. 1, where the coil spring 140 is now seated in the second groove 114 with a neutral cant. Note that the spacer 150 has been removed to enable the shaft 110 to be further inserted into the socket 130 and align the second groove 114 with the spring recess 132. As the coil spring 140 seats in the second groove 114, it favors occupying a position of neutral cant due at least in part to the increased radial depth R2 of the second groove 114. The shaft 110 can be withdrawn slightly from the socket 130 to reverse the cant to be oriented along the direction of removal. After doing so, the fin 120 can be removed with relatively low resistance. The neutral cant position shown in FIG. 5 is about half-way between the first cant and the second cant positions, in some embodiments.

Figure 6:
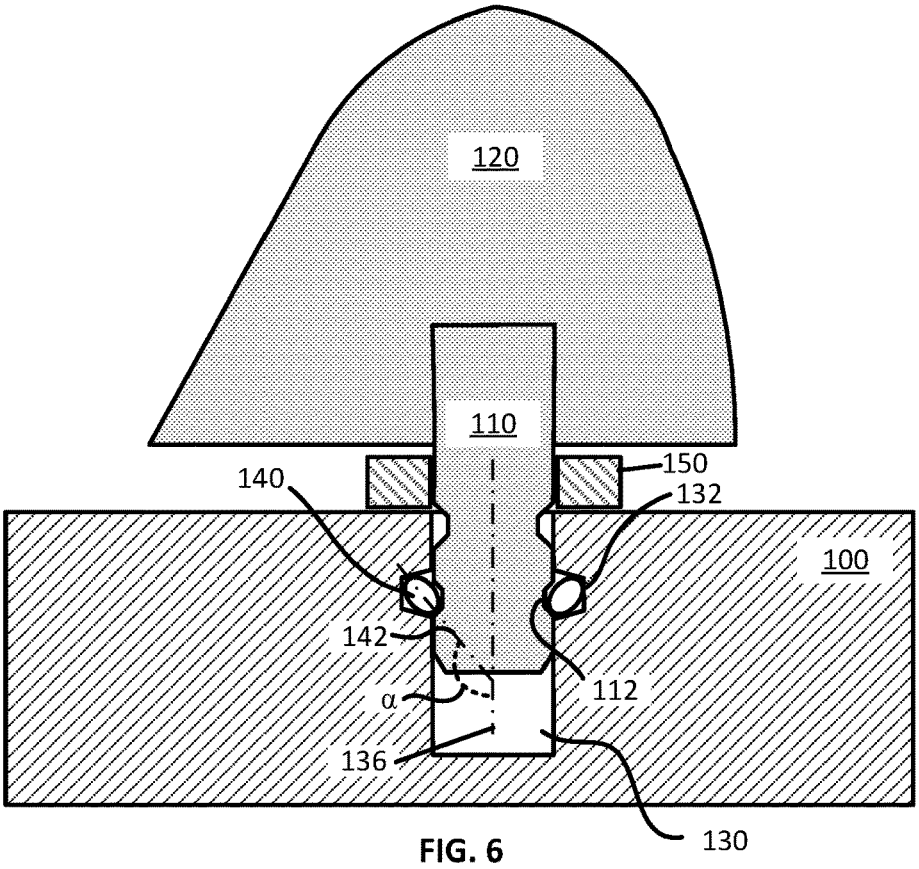
FIG. 6 illustrates a cross-sectional view showing part of a UUV with an installed replaceable fin and a spacer, where the shaft is part of the fin, in accordance with an embodiment of the present disclosure.

FIG. 6 illustrates a side and cross-sectional view of a fin 120 and part of a UUV 100, in accordance with another embodiment of the present disclosure. In this example, the shaft 110 is part of the fin 120, whether formed integrally with the fin 120 or a separate structure that is attached to the fin 120. The UUV defines the socket 130 with circumferential spring recess 132. A spacer 150 is installed on the shaft 110 to block further insertion of the shaft 110 into the socket 130 beyond the operating position. The canted coil spring 140 is seated between the first groove 112 and the spring recess 132 with the coil axis 142 inclined to the central axis 136 at an angle $\alpha$ of about 120-150°, resulting in an orientation that opposes removing the shaft 110 from the socket 130.

Figure 7:
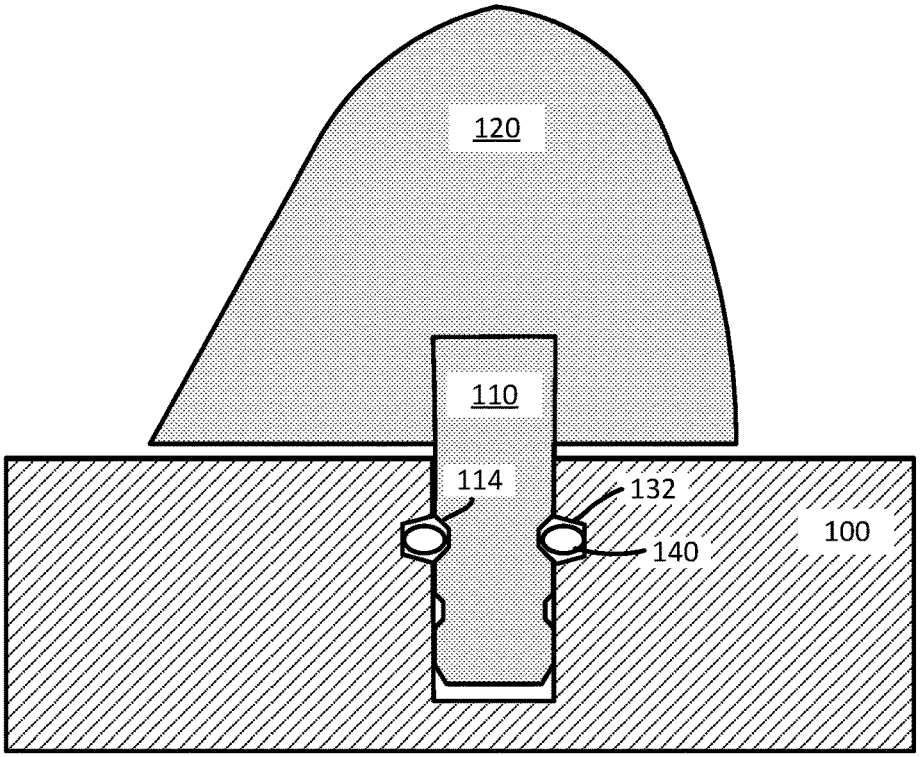
FIG. 7 illustrates a cross-sectional view of the fin and UUV of FIG. 6, where the spacer has been removed and the shaft has been inserted further into the socket so that the coil spring is seated in a second groove with a neutral cant, in accordance with an embodiment of the present disclosure.

FIG. 7 illustrates a side, cross-sectional view of the embodiment of FIG. 6 with the coil spring 140 seated in the second groove 114 with a neutral cant, in accordance with an embodiment of the present disclosure. In this position, the shaft 110 is ready for removal from the socket 130. Note that the spacer 150 has been removed from the shaft 110 and the shaft 110 has been inserted into the socket 130 so that the coil spring 140 has seated in the second groove 114 with a neutral cant. Withdrawing the shaft 110 from the socket 130 will orient the cant of the coil spring 140 to be in the direction of withdrawing the shaft 110, which is upward as shown in FIG. 7.

Figure 8:
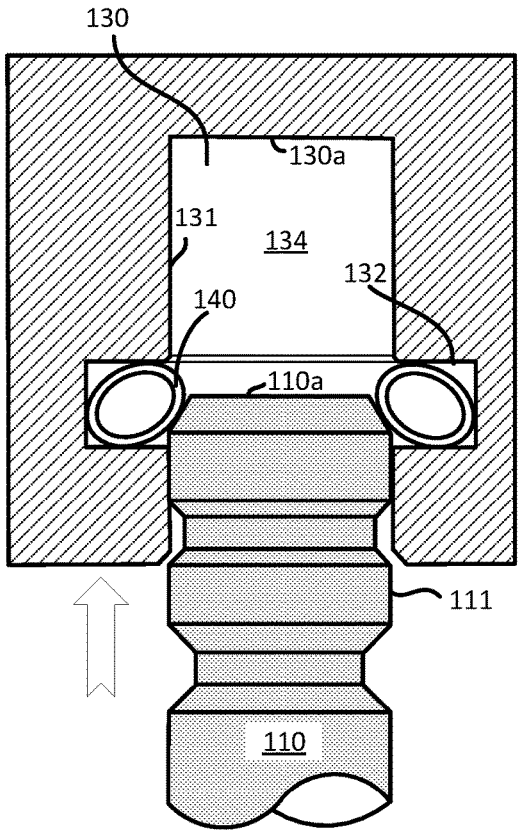
FIG. 8 illustrates a cross-sectional view of a shaft and socket with the shaft at the initial phase of being inserted into the socket, in accordance with an embodiment of the present disclosure.

Turning now to FIGS. 8-13, cross-sectional views show part of a shaft 110 and a socket 130 in various positions, in accordance with some embodiments of the present disclosure. In FIG. 8, the coil spring 140 is canted in the direction of shaft insertion, which is an upward direction in this example. As the shaft body 111 engages the coil spring 140, the coil spring 140 will attain a loaded state with an increased inner diameter ID in contact with the outside of the shaft body 111. In this cant orientation, the shaft 110 can be inserted into the socket 130 with relatively low force. In the situation where the coil spring 140 is canted in the direction of withdrawal at the time the shaft is initially inserted into the socket 130, the distal end 110*a* of the shaft 110 will reverse the cant as the shaft 110 is installed, being able to do so due to the gap 134 between the distal end 110*a* and the blind end 130*a* of the socket 130 at the time of insertion.

Figure 9:
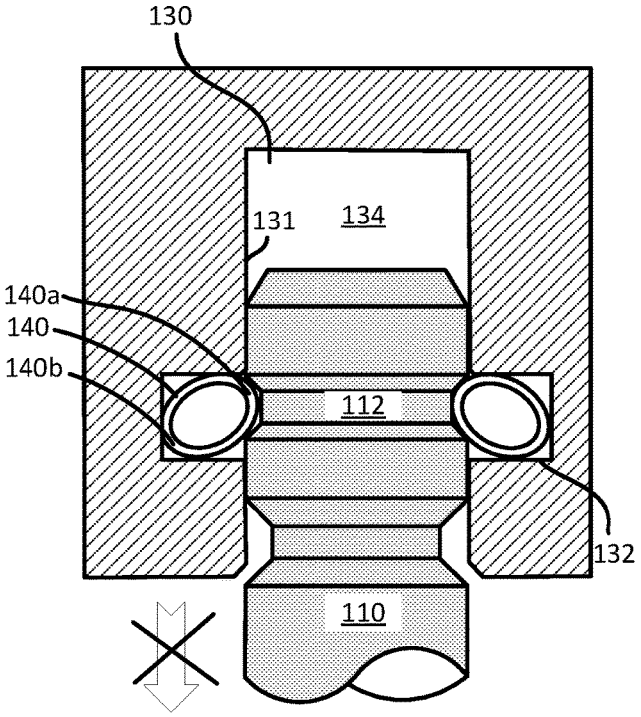
FIG. 9 illustrates a cross-sectional view of a shaft and socket with the shaft inserted into the socket so that the canted coil spring is seated between the first groove of the shaft and the spring recess of the socket, in accordance with an embodiment of the present disclosure.

In FIG. 9, the shaft 110 has been inserted into the socket 130 so that the first groove 112 aligns with the spring recess 132 and the coil spring 140 has expanded into the first groove 112 in a first canted orientation. This position may be referred to as the operating position for the shaft 110. The coil spring 140 is canted towards the insertion direction (upward as shown) with the inner radius 140*a* of the coil received in a corner of the first groove 112 and the outer radius 140*b* received in a corner of the spring recess 132. In this operating position, the coil spring 140 functions as a block to resist removal of the shaft 110 (downward direction as illustrated). In this example, the first groove 112 has a smaller axial dimension than the spring recess 132. As such, the coil spring 140 expands into the first groove 112 when the first groove aligns with a distal portion (upper portion as illustrated) of the spring recess 132, a position which also corresponds to the inner radius 140*a* of the coil spring 140.

Figure 10:
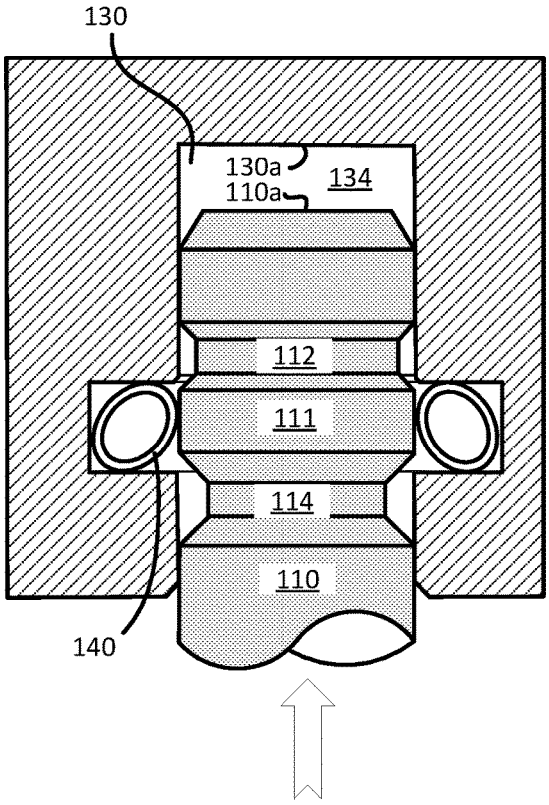
FIG. 10 illustrates a cross-sectional view of a shaft and socket, where the shaft has been inserted beyond the aligned position of the first groove and the spring recess, in accordance with an embodiment of the present disclosure.

In FIG. 10 the shaft 110 has been inserted further into the socket 130 so that the coil spring 140 engages the shaft body 111 between the first groove 112 and the second groove 114. Similar to the shaft position shown in FIG. 8, the coil spring 140 being canted in a direction of insertion results in the coil spring 140 yielding to the larger size of the shaft body 111 and allows the shaft 110 to proceed further into the socket 130 with relatively low force. A gap 134 remains between the distal end 110*a* of the shaft 110 and the blind end 130*a* of the socket 130.

Figure 11:
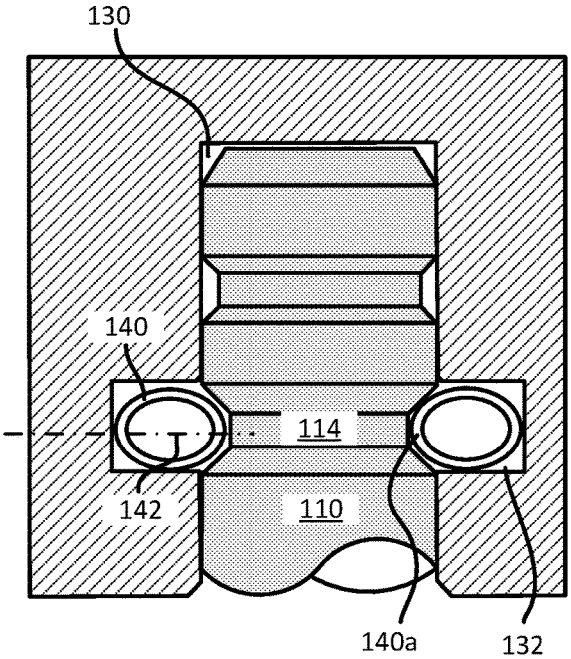
FIG. 11 illustrates a cross-sectional view of a shaft and socket, where the shaft has been fully inserted into the socket and the coil spring is seated in the second groove on the shaft, in accordance with an embodiment of the present disclosure.

In FIG. 11, the shaft 110 is substantially fully inserted into the socket 130 with the second groove 114 aligned with the spring recess 132. The coil spring 140 has occupied a position of neutral cant with the coil axis 142 substantially perpendicular to the shaft 110 and the inner radius 140*a* engaging or closely adjacent the surface of the second groove 114. From this position, retracting the shaft 110 from the socket 130 can reverse the cant of the coil spring 140 and permit relatively low-force removal of the shaft 110.

Figure 12:
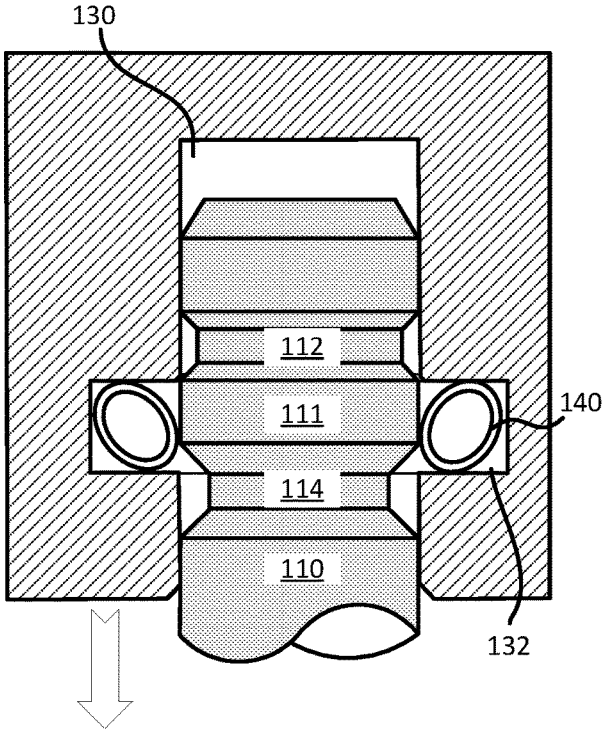
FIG. 12 illustrates a cross-sectional view of the shaft and socket of FIG. 11 after partially withdrawing the shaft from the socket, in accordance with an embodiment of the present disclosure.
Figure 13:
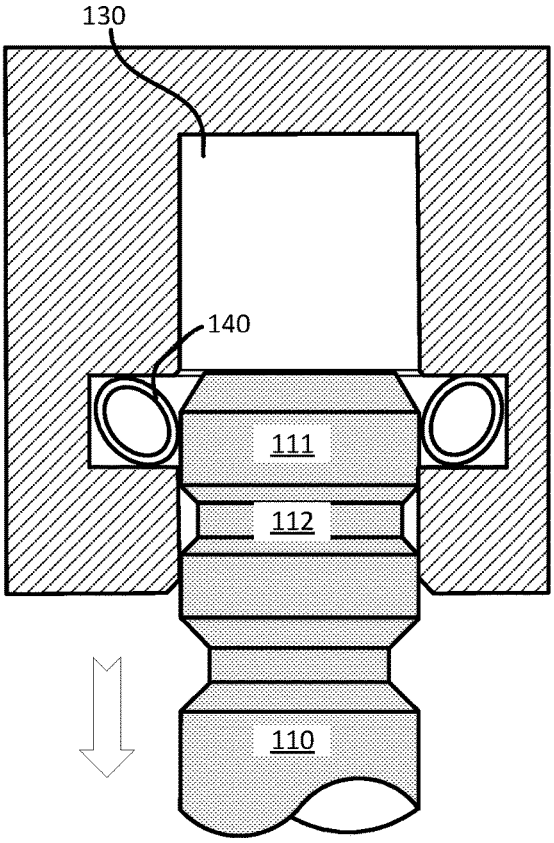
FIG. 13 illustrates a cross-sectional view of a shaft and socket of FIG. 12 after further withdrawing the shaft from the socket, in accordance with an embodiment of the present disclosure.

In FIG. 12, the shaft 110 is being withdrawn from the socket 130. Note that the coil spring 140 is now canted generally in the direction of withdrawal (down, as illustrated), permitting the coil spring 140 to yield to the shaft 110. Here, the coil spring 140 engages the shaft body 111 between the first groove 112 and the second groove 114. In FIG. 13, the shaft 110 continues to be withdrawn from the socket 130. In this example, the coil spring 140 now engages the shaft body 111 distally of the first groove 112.

Figure 14:
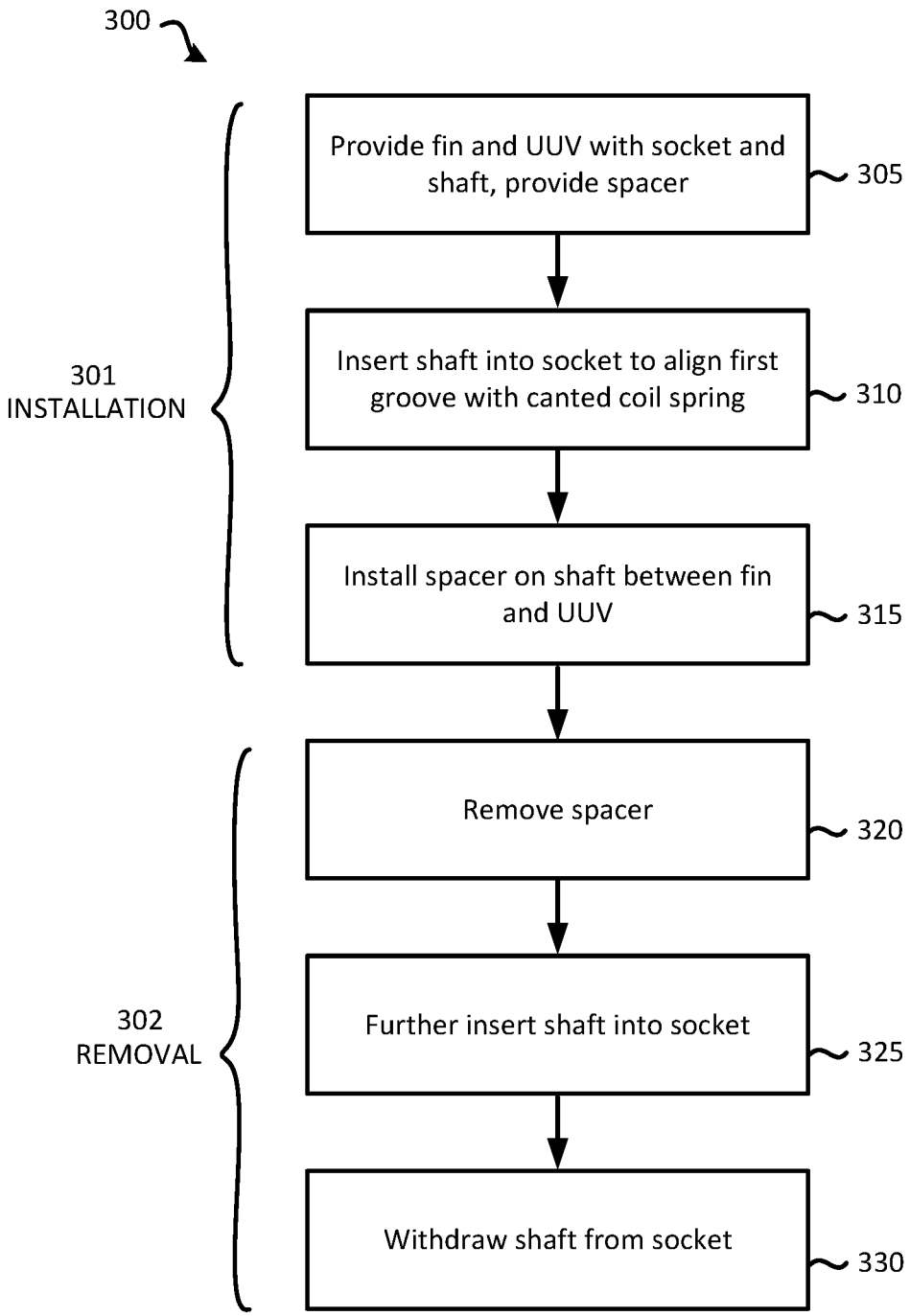
FIG. 14 is a flow chart showing steps in a method of installing and removing a fin on a UUV, in accordance with some embodiments.

FIG. 14 illustrates a method 300 of toolless fin installation 301 and fin removal 302, in accordance with embodiments of the present disclosure. In an installation portion 301 of method 300, method 300 includes providing 305 a fin and providing a UUV, where in combination the fin and the UUV have a shaft and a corresponding socket. Step 305 also includes providing a spacer. As discussed above, the shaft can be on one of the fin or the UUV and the shaft can be defined in the other of the fin or the UUV. The shaft has one or more circumferential grooves. The socket includes a circumferential spring recess and a canted coil spring retained in the spring recess.

Method 300 continues with inserting 310 the shaft into the socket to align the first groove with the coil spring. In doing so, the coil spring expands into the first groove in a canted orientation and functions as a block to prevent removal of the shaft.

Method 300 continues with installing 315 the spacer on the shaft between the UUV and the fin. The spacer can be a shaft collar, a lock ring, snap ring, or other suitable device. When installed, the spacer prevents the shaft from further insertion into the socket.

In a removal portion 302, method 300 includes removing 320 the spacer from the shaft. Method 300 continues with further inserting 325 the shaft into the socket. In the case where the shaft includes a second groove of greater radial depth, the shaft is inserted 325 to align the second groove with the spring recess and allowing the coil spring to expand into the second groove. In the case where the shaft has only one groove, or as an alternate approach, the shaft is inserted beyond the first or only groove so that the coil spring engages the shaft body.

Removing the fin continues with withdrawing 330 the shaft from the socket. In the case of the shaft having the second groove, withdrawing 330 the shaft involves reversing the cant orientation of the coil spring during an initial portion of withdrawing 330 the shaft, followed by continuing to completely withdraw 330 the shaft from the socket. In the case of the shaft having only one groove, the shaft can be rapidly withdrawn so as to prevent the coil spring from seating in the first groove.

Note that steps of method 300 are shown in a particular order for ease of description. However, one or more of the steps may be performed in a different order or may not be performed at all (and thus be optional), in accordance with some embodiments. For example, method 300 may include only steps for installing 301 the fin or only the steps for removing 302 the fin. In other embodiments, removal 302 may precede installation 301. Numerous variations on method 300 and the techniques described herein will be apparent in light of this disclosure.

Further Example Embodiments

The following examples pertain to further embodiments, from which numerous permutations and configurations will be apparent.

Example 1 is a replacement fin for an unmanned underwater vehicle. The fin includes a fin body with a base, the fin body defining a socket extending into the base and the socket including a bore having a first diameter. The socket further defines an internal circumferential groove of a second diameter that is greater than the first diameter. A canted coil spring is retained in the internal circumferential groove and has coils of an elongated coil shape. The canted coil spring can occupy a first canted position in which the coils are canted in a direction generally into the bore, and the coils can occupy a second canted position in which the coils are canted in a direction generally out of the bore.

Example 2 includes the replacement fin of Example 1, where the socket defines at least one axial keyway in communication with the bore.

Example 3 includes the replacement fin of Example 1 or 2, wherein the socket has bearing surfaces of stainless steel or titanium.

Example 4 includes the replacement fin of Example 1 or 2 where the socket comprises a polymer.

Example 5 includes the replacement fin of any one of Examples 1-4, where the socket is defined in an insert in the fin body.

Example 6 includes the replacement fin of any one of Examples 1-6, where the fin is configured as a control fin.

Example 7 is a replacement fin system comprising an underwater vehicle with an outside surface. A shaft extends outward from the outside surface of the underwater vehicle, the shaft having a shaft body with a body diameter and defining at least one circumferential groove with a groove diameter that is smaller than the body diameter. A fin defines a socket with a bore extending into the fin, the bore having a first diameter sized to receive the shaft, and the socket also having an internal spring recess of a second diameter greater than the first diameter. Aa canted coil spring is in the spring recess, where coils of the canted coil spring have a non-circular coil shape, and wherein the canted coil spring can occupy a first canted position in which the coils are canted generally into the bore and can occupy a second canted position in which the coils are canted generally out of the bore.

Example 8 includes the replacement fin system of Example 7 and further comprises a spacer configured for removable attachment to the shaft at a location between the outside surface of the underwater vehicle and the fin body.

Example 9 includes the replacement fin system of Example 7 or 8, where the at least one circumferential groove includes a first groove of a first groove diameter and a second groove of a second groove diameter smaller than the first groove diameter, wherein the first groove is axially spaced from the second groove and is positioned between a distal end of the shaft and the second groove.

Example 10 includes the replacement fin system of Example 9, where the first groove has a first axial height and the second groove has a second axial height that is greater than the first axial height.

Example 11 includes the replacement fin system of any one of Examples 7-10, where the body diameter and the first diameter of the bore differ by not more than 0.010 inch.

Example 12 includes the replacement fin system of any one of Examples 7-11, where the socket is made of or includes stainless steel or titanium. In some such embodiments, bearing surfaces are made of stainless steel or titanium.

Example 13 includes the replacement fin system of any one of Examples 7-12, where the fin body is part of a control fin of the underwater vehicle.

Example 14 includes the replacement fin system of any one of Examples 7-13, wherein the underwater vehicle is an unmanned underwater vehicle.

Example 15 is a replacement fin system comprising an underwater vehicle and a control fin. The socket includes a bore of a first diameter and an internal circumferential recess of a second diameter greater than the first diameter. A canted coil spring in the internal circumferential recess has coils of a non-circular coil shape, where the canted coil spring can occupy a first canted position in which the coils are canted generally into the socket and can occupy a second canted position in which the coils are canted generally out of the socket. The control fin has a shaft extending out from a base of the control fin, the shaft having a shaft body with a body diameter and defining at least one circumferential groove with a groove diameter that is smaller than the body diameter.

Example 16 includes the replacement fin system of Example 15 and further comprises a spacer configured for removable attachment to the shaft.

Example 17 includes the replacement fin system of Example 15 or 16, wherein the at least one circumferential groove includes a first groove of a first groove diameter and a second groove of a second groove diameter smaller than the first groove diameter, wherein the first groove is axially spaced from the second groove and the first groove is positioned axially between a distal end of the shaft and the second groove.

Example 18 includes the replacement fin system of Example 17, wherein the first groove has a first axial height and the second groove has a second axial height that is greater than the first axial height.

Example 19 includes the replacement fin system of any one of Examples 15-18, where the body diameter is smaller than the first diameter by less than 0.010 inch.

Example 20 includes the replacement fin system of any one of Examples 15-19, where the shaft is integrally formed as part of the fin.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A replacement fin for an underwater vehicle, the fin comprising:

a fin body with a base, the fin body defining a socket extending into the base, the socket including a bore having a first diameter, the socket further including an internal circumferential groove of a second diameter that is greater than the first diameter;

a canted coil spring retained in the internal circumferential groove, wherein coils of the canted coil spring have an elongated coil shape;

wherein the canted coil spring can occupy a first canted position in which the coils are canted in a direction generally into the bore, and the coils can occupy a second canted position in which the coils are canted in a direction generally out of the bore; and a spacer configured for removable attachment to a shaft into the socket.

2. The replacement fin of claim 1, wherein the socket defines at least one axial keyway in communication with the bore.

3. The replacement fin of claim 1, wherein the socket is made of stainless steel or titanium.

4. The replacement fin of claim 1, wherein an inside of the socket comprises a polymer.

5. The replacement fin of claim 1, wherein the socket is defined in an insert in the fin body.

6. The replacement fin of claim 1, wherein the fin is configured as a control fin.

7. A replacement fin system comprising:

an underwater vehicle with an outside surface;

a shaft extending outward from the outside surface of the underwater vehicle, the shaft having a shaft body with a body diameter and defining at least one circumferential groove with a groove diameter that is smaller than the body diameter;

a fin defining a socket with a bore extending into the fin, the bore having a first diameter sized to receive the shaft, the socket also having an internal spring recess of a second diameter greater than the first diameter;

a canted coil spring in the spring recess, wherein coils of the canted coil spring have a non-circular coil shape, and wherein the canted coil spring can occupy a first canted position in which the coils are canted generally into the bore and a second canted position in which the coils are canted generally out of the bore; and a spacer configured for removable attachment to the shaft at a location between the outside surface of the underwater vehicle and the fin body.

8. The replacement fin system of claim 7, wherein the at least one circumferential groove includes a first groove of a first groove diameter and a second groove of a second groove diameter smaller than the first groove diameter, wherein the first groove is axially spaced from the second groove and is positioned between a distal end of the shaft and the second groove.

9. The replacement fin system of claim 8, wherein the first groove has a first axial height and the second groove has a second axial height that is greater than the first axial height.

10. The replacement fin system of claim 7, wherein the body diameter and the first diameter of the bore differ by less than 0.010 inch.

11. The replacement fin system of claim 7, wherein the socket is made of stainless steel or titanium.

12. The replacement fin system of claim 7, wherein the fin body is part of a control fin of the underwater vehicle.

13. The replacement fin system of claim 7, wherein the underwater vehicle is an unmanned underwater vehicle.

14. A replacement fin system comprising:

an underwater vehicle defining a socket, the socket including a bore of a first diameter and an internal circumferential recess of a second diameter greater than the first diameter;

a canted coil spring in the internal circumferential recess, wherein coils of the canted coil spring have a non-circular coil shape, and wherein the canted coil spring can occupy a first canted position in which the coils are canted generally into the socket and a second canted position in which the coils are canted generally out of the socket;

a control fin having a shaft extending out from a base of the control fin, the shaft having a shaft body with a body diameter and defining at least one circumferential groove with a groove diameter that is smaller than the body diameter; and a spacer configured for removable attachment to the shaft.

15. The replacement fin system of claim 14, wherein the at least one circumferential groove includes a first groove of a first groove diameter and a second groove of a second groove diameter smaller than the first groove diameter, wherein the first groove is axially spaced from the second groove and the first groove is positioned axially between a distal end of the shaft and the second groove.

16. The replacement fin system of claim 15, wherein the first groove has a first axial height and the second groove has a second axial height that is greater than the first axial height.

17. The replacement fin system of claim 16, wherein the body diameter is smaller than the first diameter by no more than 0.010 inch.

18. The replacement fin system of claim 14, wherein the shaft is integrally formed as part of the fin.

* * * * *